United States Patent [19]

Cherrin

[11] 3,989,175

[45] Nov. 2, 1976

[54] DISPENSER FOR ADHESIVE PRODUCTS

[75] Inventor: Phil Cherrin, Huntington Woods, Mich.

[73] Assignees: Phil Cherrin, Huntington Woods; Abe Cherrin; Lem Cherrin, both of Southfield, all of Mich.

[22] Filed: Nov. 6, 1974

[21] Appl. No.: 521,397

Related U.S. Application Data

[63] Continuation-in-part of Ser. No. 368,206, June 8, 1973, abandoned.

[52] U.S. Cl. ..... 225/76; 225/46; 225/77; 225/88; 281/6

[51] Int. Cl.[2] ..... B26F 3/02

[58] Field of Search ..... 225/18, 31, 10, 24, 225/23, 89, 88, 90, 36, 39, 76, 46, 43, 52, 77; 281/6, 10; 242/55.2

[56] References Cited

UNITED STATES PATENTS

| | | | |
|---|---|---|---|
| 1,165,720 | 12/1915 | Seelman, Jr. | 281/6 |
| 1,597,795 | 8/1926 | Jacobus | 281/6 |
| 1,802,339 | 4/1931 | Feddern | 225/31 X |
| 1,802,339 | 4/1931 | Uttz, Sr. | 225/23 |
| 2,892,596 | 6/1959 | Fishel | 225/89 X |

FOREIGN PATENTS OR APPLICATIONS

| | | | |
|---|---|---|---|
| 276,057 | 11/1969 | Austria | 225/77 |
| 17,395 | 9/1896 | United Kingdom | 225/76 |
| 7,017 | 2/1889 | United Kingdom | 225/77 |

*Primary Examiner*—Leon Gilden
*Attorney, Agent, or Firm*—Harness, Dickey & Pierce

[57] ABSTRACT

A novel tape dispenser especially useful in dispensing pressure-sensitive adhesive tape of the type having a plurality of longitudinally spaced zones which appreciably increase the force required to strip the tape from the roll compared to areas intermediate these zones. Features of the invention include: an adjustable blade on the dispenser frame, in one embodiment, which may set at desired distances from the roll to accommodate various dimensional characteristics of different tapes; a limiting structure for preventing the roll of tape from being pulled bodily out of the dispenser; and a unique arrangement for mounting and maintaining the tape such that the line of departure of tape from the roll is maintained in fixed position on the dispenser frame.

In one embodiment the support means for the tape roll defines a path inclining downwardly toward a lip on the frame across which tape is drawn as it is stripped from the roll. In another form, the spindle rotatably supports the roll and has slots at opposite ends guided by inturned flanges on the frame.

1 Claim, 5 Drawing Figures

DISPENSER FOR ADHESIVE PRODUCTS

This application is a continuation-in-part of my copending application Ser. No. 368,206 filed June 8, 1973, now abandoned.

BACKGROUND AND SUMMARY OF THE INVENTION

The present invention relates to a dispenser for dispensing tape from a roll and in particular, to a dispenser which is especially useful in dispensing pressure-sensitive adhesive tape of the type having a plurality of longitudinally spaced zones which appreciably increase the force required to strip the tape from the roll compared to areas intermediate these zones.

In the U.S. Pat. No. 3,559,856, issued Feb. 2, 1971, there is disclosed apparatus for dispensing an adhesive product from a roll. The adhesive product disclosed therein is a continuous series of equal length end-to-end interconnected handles. The product has longitudinally equally spaced zones of greater adhesion which are separated by zones of lesser adhesion. As the strip is unwound from the roll, less effort is required to peel the less adhesive zones from the roll than is required to peel the more adhesive zones from the roll. Thus, the person peeling the strip from the roll can readily sense the greater resistance to unpeeling which is encountered when there is a transition from a less adhesive region to a more adhesive region being peeled from the roll; this has the effect of creating a natural stop during unwinding of the strip. By arranging the dispenser such that the line of departure of the tape from the roll (i.e. the line along which the tape is peeled from the roll) is maintained a fixed distance from a severing edge on the dispenser, equal length increments of product can be severed from the roll by drawing the unwound portion of the strip across the severing edge upon sensing the suddenly increased unwinding resistance when a more adhesive region is encountered. By maintaining this fixed distance such that the severing edge is positioned to sever the unwound strip at the middle of one of the more adhesive zones, equal length handles having adhesive at lengthwise opposite ends thereof are dispensed.

According to the disclosure of this prior patent, the dispenser for dispensing tape product in this fashion has a roller journalled for rotation on the dispenser frame and the roll of tape is supported directly on the roller. Tape is stripped from the roll at the line of contact between the roll of tape and the roller and thereafter wraps around a portion of the periphery of the roller and then extends away from the roller toward the severing blade. One of the disadvantages of this dispenser is that loading of a roll of tape is made difficult because the tape must be threaded around the roller and then directed along the dispenser to the cutting blade. Furthermore, this arrangement requires that the roller support the full weight of the roll of tape; and the roller also constitutes a moving part of the dispenser. The dispenser requires the use of an additional roller to accommodate a different length of severed product.

The present invention is directed to a novel tape dispenser; which requires no moving parts; which is easier and simpler to load; which can be made more cheaply; and which can be easily adjusted to accommodate the specific dimensional characteristics of the particular tape which is to be dispensed. Several of the advantages of the present invention arise through the recognition that, contrary to the teachings of the prior art as evidenced by the above patent, it is unnecessary to use a roller on the dispenser for dispensing adhesive product having alternate zones of greater and lesser adhesion. Thus, the novel dispenser structure of the present invention obviates the need to use a roller and hence requires no moving parts. Furthermore, in contrast to the use of multiple rollers in the prior art patent to attain the desired adjustability of the path length of the tape between its line of departure from the roll and the severing blade, the present invention in one embodiment, incorporates an adjustable blade on the dispenser which may be quickly and easily adjusted to provide the requisite path length for the specific product being dispensed. Further aspects of the invention reside in the novel support arrangement of the roll relative to the line of departure of the tape from the roll and in the way in which the roll is prevented from being displaced bodily out the dispenser as tape is pulled from the roll. The advantages of the novel tape dispenser of the present invention provide optimum benefit when dispensing adhesive product having alternate zones of greater and lesser adhesion, and it is to be understood that a zone of lesser adhesion could be one of no adhesion at all. Accordingly, a dispenser embodying the principles of the invention is well suited to dispense tape products of the type disclosed and claimed in applicant Phil Cherrin's copending application Ser. No. 294,627, entitled "Shipping Device and Method", filed Oct. 3, 1972. It will be appreciated, however, that the dispenser of the present invention may also be used to dispense conventional as well as various other type tape products from rolls.

The foregoing advantages and features of the invention along with additional benefits and objects thereof will be seen in the ensuing description and claims which are to be taken in conjunction with the accompanying drawing.

BRIEF DESCRIPTION OF THE DRAWING

The drawing illustrates preferred embodiments of the invention in accordance with the best mode presently contemplated for carrying out the invention.

DESCRIPTION OF THE PREFERRED EMBODIMENTS

Figure 1:
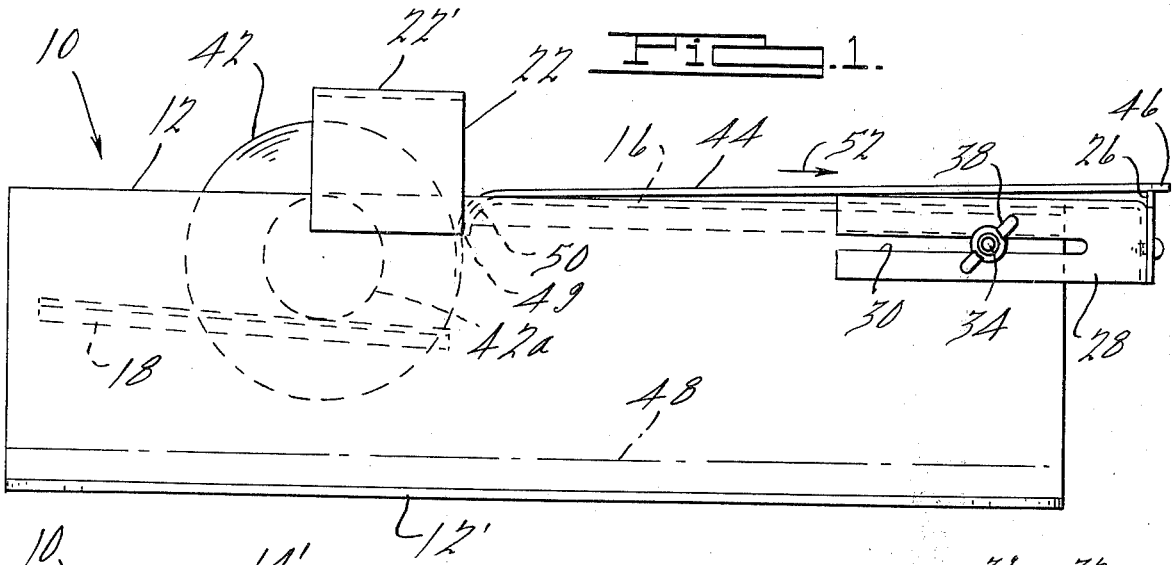
FIG. 1 is a side elevation view of a dispenser emboying the principles of the present invention.
Figure 2:
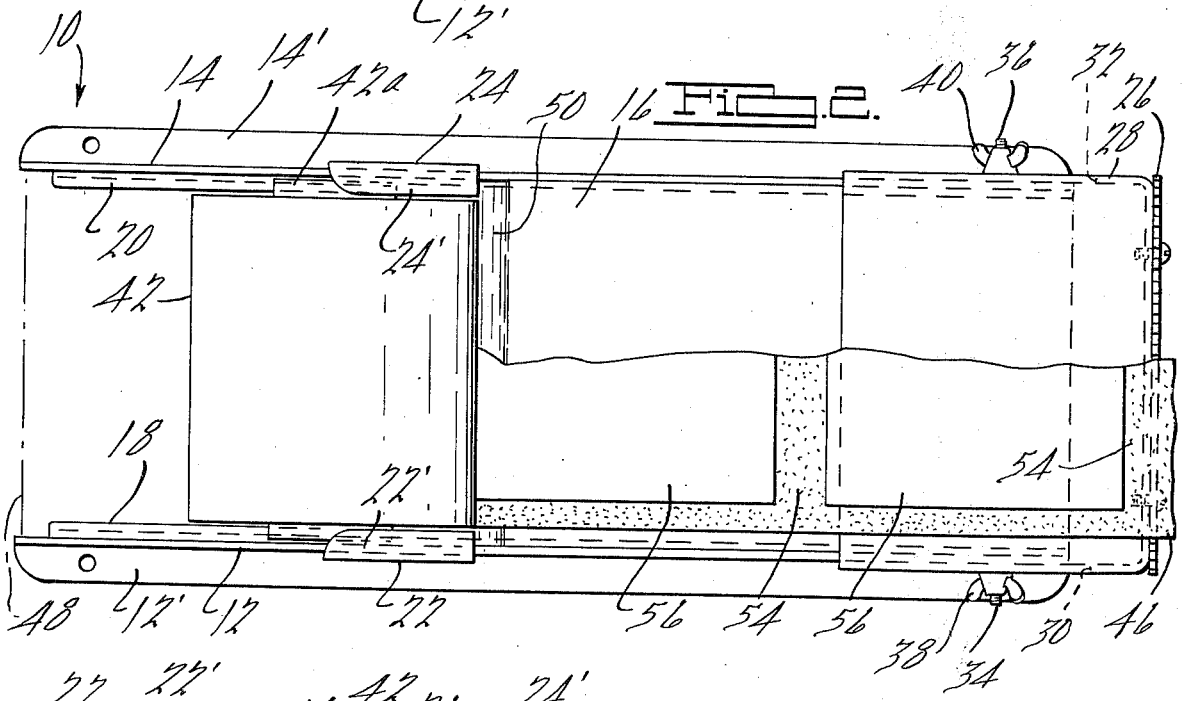
FIG. 2 is a top plan view of the dispenser of FIG. 1.
Figure 3:
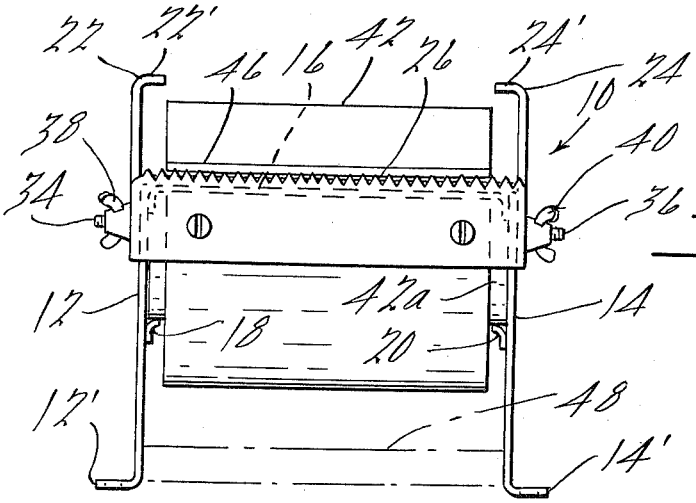
FIG. 3 is an end elevational view of the dispenser of FIG. 1.

Referring to the embodiment of FIGS. 1 to 3, the tape dispenser 10 of the present invention shown in the drawings comprises a frame structure having a pair of transversely spaced, longitudinally extending, parallel vertical side members 12 and 14, which are bridged by a generally flat horizontal, longitudinally extending support member 16 affixed to members 12 and 14 along the forward portions of the upper edges thereof. A pair of inclined angle sections 18 and 20 are affixed to the inner sides of members 12 and 14, respectively, longitudinally rearwardly of member 16. A pair of limit brackets 22 and 24 are affixed to side members 12 and 14, respectively, adjacent the rear end of member 16. A serrated cutting blade 26 is affixed to the forward end of a blade support 28, and the latter is longitudinally adjustable on the dispenser frame via a pair of slots 30 and 32 which are guided on threaded studs 34 and 36, respectively, on side members 12 and 14, respectively. Support 28 is locked in position by wing nuts 38 and 40 on studs 34 and 36.

The drawings also illustrate a roll of tape 42 loaded in dispenser 10 with the stripped portion 44 of the tape extending longitudinally forwardly from roll 42. In particular, FIGS. 1 and 3 show the orientation of the tape as the tape is being drawn across blade 26 to sever the free end segment 46 from the strip. In FIG. 2, a fragmentary section of the unwound tape is broken away to illustrate more clearly the underlying construction of the dispenser.

Dispenser 10 is oriented in a generally horizontal position as indicated in the drawing and may include an optional weight 48 to weight down the dispenser in the event that mounting holes in the out-turned flanges 12' and 14' along the bottom edges of side members 12 and 14 are not used to attach the dispenser to a horizontal mounting platform such as a tale or the like. The open rear portion of the dispenser between side members 12 and 14 provides an open receptacle into which roll 42 may be dropped. In the illustrated construction, tape 42 is wound on a reel 42*a*, and the tape roll and reel are dimensioned such that reel 42*a* rests on angle sections 18 and 20 to support roll 42 for translation and rotation when the roll is loaded into the dispenser. Angle sections 18 and 20 incline downwardly in the forward direction at a small acute angle relative to the horizontal forming an inclined ramp on which the roll is supported. The periphery of the roll of tape is thereby maintained by force of gravity against the free smooth edge 49 of a smooth curled lip 50 extending transversely across the rear of member 16. The stripped portion 44 of the tape is drawn with its adhesive side up in a generally forward direction (as indicated by the arrow 52 in FIG. 1) to peel tape from the roll. Because roll 42 is urged against lip 50, tape is stripped from roll 42 along a line of departure substantially at the line of contact of the roll with the lip regardless of the amount of tape remaining on the roll. As tape is stripped from the roll, it is drawn across the smooth convex upper surface of lip 50 without damage to the tape and without a large frictional force between the tape and the lip. It will be observed that since roll 42 is gravity-biased along the ramp provided by sections 18 and 20 at only a small acute angle relative to the horizontal, the force of the roll against lip 50 is only a small fraction of the weight of the roll and yet this has been found to be sufficient to fixedly locate the line of departure of the tape from the roll relative to blade 28 as tape is dispensed. Accordingly, the need to have the tape bear against a roller on the dispenser to provide proper dispensation of tape product (as taught by the above prior patent), is totally unnecessary in light of this aspect of the present invention. The arrangement is preferably dimensioned such that the line of contact between roll 42 and lip 50 is disposed vertically above the axis of the roll of tape for all operative positions of the roll as tape is drawn therefrom since this reduces any tendency for the entire roll to be pulled bodily over the lip and out of the dispenser when tape is drawn from the roll.

Where the tape on roll 42 is of the type having a repeat pattern consisting of equally longitudinally spaced zones of greater adhesive, such as zones 54 in FIG. 2, separated by zones of lesser adhesive, such as zones 56 in FIG. 2, blade 26 is positioned on the frame relative to lip 50 such that the length of the path of tape from its line of departure from the roll to blade 26 is maintained at a distance equal to a whole multiple of the length of one repeat less approximately one-half the longitudinal dimension of a greater adhesive zone 54, one repeat being equal to the distance along the tape from a selected location on one type of zone to the corresponding location on the immediately adjacent zone of the same type. In FIG. 2, it can be seen that the path length between blade 26 and the line of departure of the tape from the roll equals two repeats less one-half the length of a more adhesive zone 54. As tape is pulled from the roll, the middle of each more adhesive zone 54 is positioned to be drawn across blade 26 as each succeeding more adhesive zone 54 is encountered during stripping of the tape from the roll. Thus, when the user senses the greatly increased resistance to stripping when each more adhesive zone 54 is encountered on the roll, the dispenser blade position automatically defines the line of severing for each tape segment 46. Therefore, upon sensing the increased stripping resistance, the user, rather than now exerting a much greater pull on the tape to overcome the increased resistance, simply holds the tape taut while drawing it downwardly across blade 26 to sever the free end segment of the tape. As the diameter of roll 42 becomes smaller, reel 42*a* rides downwardly and forwardly along sections 18 and 20 to always maintain the line of departure of the strip from the roll at free edge 49. Thus, equal length increments of product having adhesive at lengthwise opposite ends thereof are always dispensed.

Brackets 22 and 24 constitute a further inventive feature to prevent roll 42 from being pulled bodily out of the dispenser when tape is pulled from the roll. While it is contemplated, and in fact has been observed, that with particular tapes there is no tendency of the roll to be pulled out of the dispenser when tape is withdrawn, it is foreseeable that where a light-weight tape is used and/or the tape is nearly exhausted from the roll, the force required to peel the tape from the roll may in certain instances have a tendency to lift the roll out of the dispenser. Therefore, brackets 22 and 24 have inwardly turned flanges 22' and 24' at the top edges thereof which are separated by a distance which is less than the width of reel 42*a*. Furthermore, the minimum dimension between lip 50 and flanges 22' and 24' is less than the diameter of reel 42*a*. Thus, brackets 22 and 24 cooperate with lip 50 to define a limiting aperture through which reel 42*a* cannot be drawn should the roll be lifted bodily upwardly out of the dispenser when tape is pulled from the roll. The brackets, however, are dimensioned so as not to interfere with a maximum diameter roll when a new roll is installed. Naturally, the brackets could be constructed to constrain the roll of tape itself rather than the reel where tape is not mounted on a reel.

Figure 4:
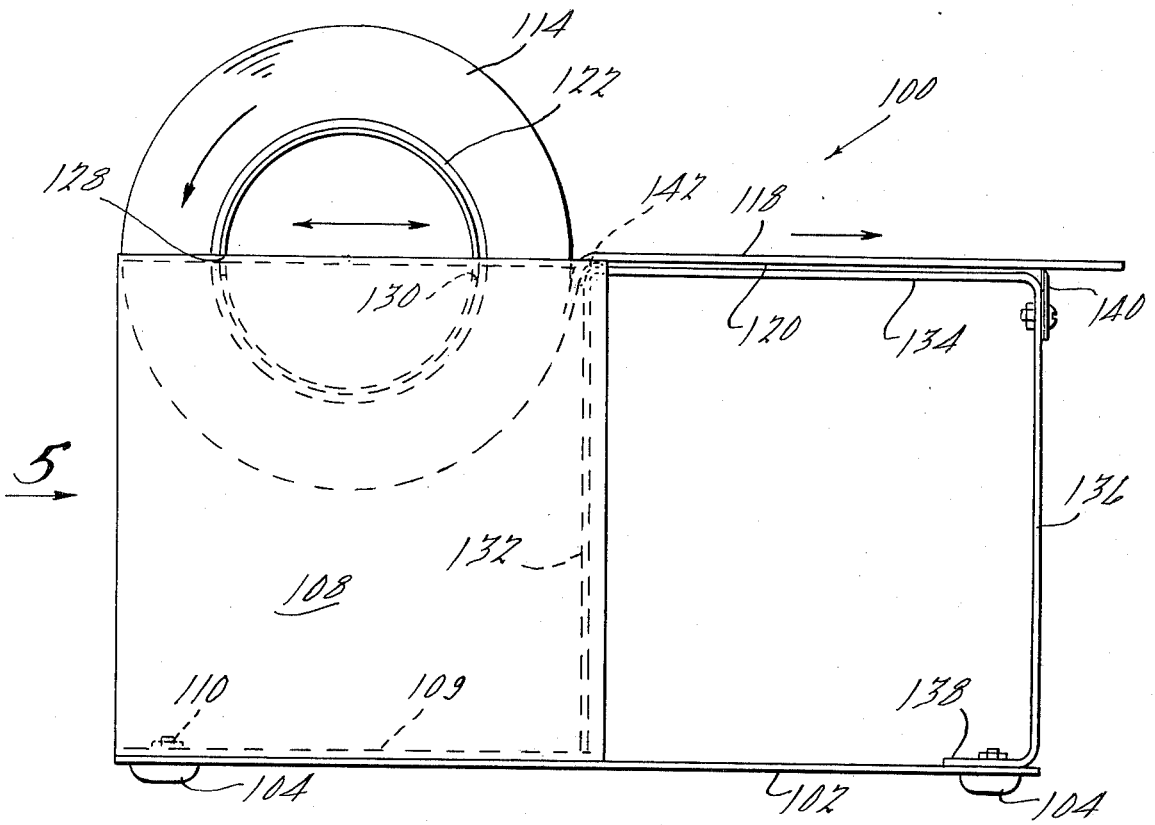
FIG. 4 is a side elevational view of another embodiment of the dispenser utilizing a guided spindle.
Figure 5:
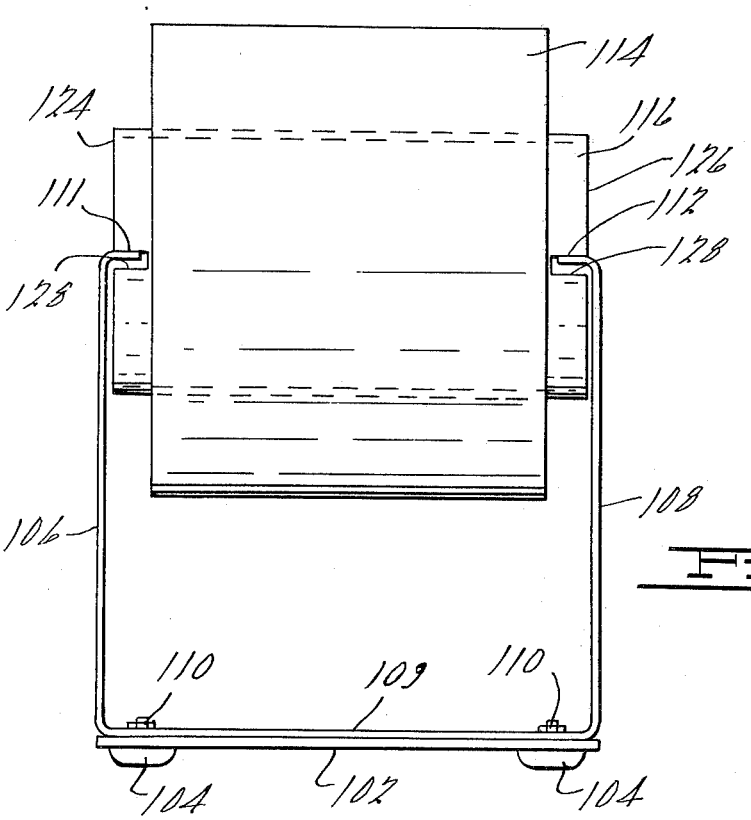
FIG. 5 is a rear elevational view of this embodiment taken in the direction of arrow 5 of FIG. 4.

FIGS. 4 and 5 show a second embodiment of the invention which incorporates the same basic principles as the first embodiment but has a somewhat different supporting means for the tape roll. The tape dispenser of this embodiment is generally indicated at 100 and comprises a flat rectangular base 102 with feet 104, and a pair of transversely spaced, longitudinally extending, parallel vertical side members 106 and 108. These side members are united by a bottom member 109 secured by nuts 110 to base 102. The side members are spaced apart by a distance equal to the width of base 102, and their upper edges have horizontal inturned flanges 111 and 112 respectively, as seen in FIG. 5. The rear edges of members 106 and 108 define an opening for the reception of a roll of a tape 114 and a supporting spindle 116. The tape roll may be of the type described with respect to the previous embodiment, having a repeat pattern consisting of equal longitudinally spaced zones of greater adhesive separated by zones of lesser adhesive on the inside surface 118, the outside surface 120 being completely non-adhesive. The inside of roll 114 is preferably provided with a tubular non-adhesive liner 122. The width of roll 114 is slightly less than the distance between inturned flanges 111 and 112.

Spindle 116 is preferably constructed of a non-friction material such as polyvinyl chloride and has an outside diameter which will enable it to slip into and be rotatable with respect to liner 122. The length of tubular spindle 116 is slightly less than the distance between side members 106 and 108. The opposite ends 124 and 126 of spindle 116 are each provided with a pair of diametrically opposed slots 128 and 130. These slots are wide enough to accommodate flanges 111 and 112 when the assembly spindle and tape roll are slipped onto the flanges, as seen in the drawings. The diameter of spindle 116 is sufficiently great as to maintain the non-rotative position of spindle 116 when tape is being unwound from the roll, while permitting the spindle-tape roll assembly to continually slide forwardly as tape is unwound.

A vertical member 132 extends between the forward portions of members 106 and 108 and is secured thereto. A horizontal support surface 134 extends forwardly from the upper edge of member 132 and is secured at its forward edge to a vertical wall 136 parallel to member 132 and extending downwardly, the lower end 138 of wall 136 being inturned and secured to the forward edge of base 102. Support member 134 is approximately at the level of flanges 111 and 112. A blade and guard 140 is secured to the forwardly facing surface of wall 136 at its upper edge and extends slightly above support surface 134.

A convex curved lip 142 is mounted at the juncture of member 132 with support member 134, and extends transversely between members 106 and 108. Where tape roll 114 is of the type previously indicated having a repeat pattern, blade 140 is spaced relative to convex curved lip 142 such that the length of the path of tape from its line of departure from the roll (at lip 142) to blade 140 is equal to a whole multiple of the length of one repeat, plus aproximately one-half the longitudinal dimension of the zone of greater adhesion.

In operation of the embodiment of FIGS. 4 and 5, as tape is pulled from the roll, the middle of each more adhesive zone is positioned to be drawn across blade 140 as a succeeding more adhesive zone is encountered during stripping of the tape from the roll. The user sensing this increased resistance to stripping will draw the tape downwardly across blade 142 severing the desired segment of the tape. As the diameter of roll 114 decreases, the roll will automatically move toward lip 142 as the tape is being stripped, slots 128 and 130 riding on flanges 111 and 112. This will ensure that the line of departure of the strip from the roll does not change and that equal lengths of the tape are dispensed.

From the foregoing detailed description of the preferred embodiments, it can be seen that the present invention provides a novel tape dispenser which has many advantageous features over the prior art. In particular, the dispenser requires no moving parts and can be fabricated and manufactured economically. The severing blade in one embodiment can be conveniently adjusted on the dispenser to accommodate various tape products having different dimensional characteristics; thus, the dispenser may be used with a wide variety of tape products. Furthermore, it will be observed that the loading of the roll of tape is greatly facilitated since the roll may be simply dropped into the dispenser and the free end of the tape pulled forwardly of the roll along the dispenser; thus, the tape need not be threaded around various rollers and passages in the dispenser.

It is to be understood that the foregoing description is that of preferred embodiments of the invention. Various changes and modifications may be made without departing from the spirit and scope of the invention as defined by the appended claims.

I claim:

1. A dispenser for use with a roll of pressure-sensitive tape having a plurality of longitudinally spaced zones which appreciably increase the force required to strip the tape from the roll compared to the areas intermediate said zones, said zones being substantially equally spaced apart and of substantially equal predetermined longitudinal extent thereby defining a longitudinal repeat of predetermined length, said dispenser comprising; dispenser frame means, a lip on said frame means across which tape is drawn as tape is stripped from the roll, said lip extending continuously across said frame means; support means on said frame means arranged to rotatably support the roll of tape and maintain the same against said lip along a line of contact therebetween with tape being stripped from the roll along a line of departure substantially at said line of contact; severing means on said frame means operable along a line of severing extending across the tape; said line of contact of the roll with said lip being along a free edge of said lip, the lip having a convex curved surface curving away from said free edge and merging into a horizontal support surface defining the remainder of the path of travel of the tape between said lip and said severing means, the tape being drawn across said curved surface as it is stripped from the roll; said frame means comprising an elongated flat base, a pair of transverse spaced members comprising vertical walls extending upwardly from the rear portion of said base, said tape roll support means comprising a pair of inturned horizontal flanges along the upper portions of said vertical walls substantially at the level of said lip, an annular spindle rotatably supporting said tape roll, and means on said spindle slidably but non-rotatably mounting the spindle on said flanges, said last mentioned means comprising a pair of diametrically opposed slots on each side of said spindle and receiving said flanges, and said lip being disposed relative to said severing means such that the distance from the said severing means to said lip is positionable whereby a distance is maintained equal to a whole multiple of said predetermined length of said repeat less a distance smaller than said predetermined longitudinal extent of each zone.

* * * * *